US009822535B2

(12) United States Patent
Maini et al.

(10) Patent No.: US 9,822,535 B2
(45) Date of Patent: Nov. 21, 2017

(54) SEGMENT OF AN ARTICULATED ARM AND ARTICULATED ARM COMPRISING SAID SEGMENT

(71) Applicant: CIFA SPA, Senago (IT)

(72) Inventors: Paolo Dario Maini, Monza (IT); Nicola Pirri, Milan (IT)

(73) Assignee: CIFA SPA, Senago (IT)

( * ) Notice: Subject to any disclaimer, the term of this patent is extended or adjusted under 35 U.S.C. 154(b) by 435 days.

(21) Appl. No.: 14/377,641

(22) PCT Filed: Feb. 14, 2013

(86) PCT No.: PCT/IB2013/000186

§ 371 (c)(1),
(2) Date: Aug. 8, 2014

(87) PCT Pub. No.: WO2013/121269

PCT Pub. Date: Aug. 22, 2013

(65) Prior Publication Data

US 2015/0090850 A1 Apr. 2, 2015

(30) Foreign Application Priority Data

Feb. 14, 2012 (IT) ..... MI2012A0206

(51) Int. Cl.
*B66C 23/64* (2006.01)
*E04G 21/04* (2006.01)
(Continued)

(52) U.S. Cl.
CPC ..... *E04G 21/0445* (2013.01); *B66C 23/64* (2013.01); *B66C 23/68* (2013.01); *B66C 23/70* (2013.01); *E02F 3/38* (2013.01)

(58) Field of Classification Search
CPC ..... E02F 3/38
See application file for complete search history.

(56) References Cited

U.S. PATENT DOCUMENTS 3,275,163 A * 9/1966 Schaeff ..... E02F 3/32 280/766.1
3,465,904 A * 9/1969 Pietro ..... E02F 3/301 414/694

(Continued)

FOREIGN PATENT DOCUMENTS

DE 7512695 8/1975

OTHER PUBLICATIONS

International Search Report and Written Opinion of PCT/IB2013/000186 dated Apr. 26, 2013, 7 pages.

*Primary Examiner* — William Kelleher
*Assistant Examiner* — Gregory Prather
(74) *Attorney, Agent, or Firm* — Rankin, Hill & Clark LLP

(57) ABSTRACT

Segment of an articulated arm made of composite material, with an elongated shape defining a longitudinal axis, and having a box-like cross section. The segment includes a first end portion, configured for the pivoting of a further segment, a second intermediate portion configured for the pivoting of an actuation member, and a third end portion. The first, second and third portions are made in a single body. The second intermediate portion includes a protruding zone defined by a first side and by a second side converging with respect to each other to define a top. Pivoting elements are provided in the protruding zone for the pivoting of the actuation member between the protruding zone and the first end portion. The first and the second side defining the protruding zone are filleted to substantially rectilinear adjacent tracts of the first and third end portions.

17 Claims, 2 Drawing Sheets

(51) Int. Cl.

| | |
|---|---|
| ***B66C 23/68*** | (2006.01) |
| ***B66C 23/70*** | (2006.01) |
| ***E02F 3/38*** | (2006.01) |

(56) References Cited

U.S. PATENT DOCUMENTS 3,722,864 A * 3/1973 Borer ..... B62D 55/10 14/3
3,807,586 A * 4/1974 Holopainen ..... B60P 3/42 180/14.1
4,029,225 A * 6/1977 Wirt ..... E02F 3/301 414/694
4,392,314 A 7/1983 Albrecht et al.
4,405,281 A * 9/1983 Ruttershoff ..... E02F 3/36 414/694
4,428,173 A 1/1984 Knell
4,686,782 A * 8/1987 Nagatomo ..... E02F 3/30 37/443
5,245,770 A * 9/1993 Ko ..... B29C 70/347 264/46.5
5,282,566 A * 2/1994 Lammers ..... B23K 31/02 228/161
5,316,709 A 5/1994 Ko et al.
5,360,313 A * 11/1994 Gilmore, Jr. ..... E02F 3/301 403/45
5,599,158 A * 2/1997 Ajilore ..... E02F 3/283 414/685
5,611,657 A * 3/1997 Peterson ..... E02F 3/38 414/686
6,428,265 B1 * 8/2002 Gilmore, Jr. ..... E02F 3/3627 37/468
6,758,024 B1 * 7/2004 Mieger ..... E02F 3/38 52/839
6,786,233 B1 * 9/2004 Anderson ..... B66C 23/64 137/615
9,315,966 B2 * 4/2016 Sugaya ..... E02F 3/38
2003/0035710 A1 * 2/2003 Cusack ..... E02F 3/425 414/694
2003/0126772 A1 * 7/2003 Masumoto ..... E02F 3/38 37/466
2004/0161326 A1 * 8/2004 Yamaguchi ..... E02F 3/38 414/722
2004/0191043 A1 * 9/2004 Davis ..... E02F 3/38 414/722
2006/0021264 A1 * 2/2006 Grobenstieg ..... E02F 3/38 37/444
2006/0042131 A1 * 3/2006 Pinther ..... B66C 23/707 37/466
2007/0124963 A1 * 6/2007 Ishikawa ..... E02F 3/301 37/446
2009/0129908 A1 * 5/2009 Oyamada ..... E02F 3/38 414/713
2009/0223093 A1 * 9/2009 Willaredt ..... E02F 3/38 37/403
2009/0304485 A1 * 12/2009 Yoshikawa ..... E02F 3/301 414/723
2010/0018195 A1 * 1/2010 Stanger ..... E02F 9/2217 60/414
2010/0119344 A1 * 5/2010 Nabata ..... E02F 3/38 414/722
2010/0230371 A1 * 9/2010 Pirri ..... B66C 23/64 212/347
2011/0002765 A1 * 1/2011 Asam ..... E02F 3/38 414/722
2011/0220228 A1 * 9/2011 Maini ..... B66C 23/64 137/615
2013/0333829 A1 * 12/2013 Pirri ..... B66C 23/64 156/173
2014/0056677 A1 * 2/2014 Takahashi ..... E02F 3/38 414/727
2014/0334906 A1 * 11/2014 Takahashi ..... E02F 9/006 414/727
2015/0336778 A1 * 11/2015 Ditzler ..... A01D 34/866 248/68.1
2016/0222623 A1 * 8/2016 Wagner ..... E02F 3/342
2016/0222624 A1 * 8/2016 Wagner ..... E02F 3/342

* cited by examiner

SEGMENT OF AN ARTICULATED ARM AND ARTICULATED ARM COMPRISING SAID SEGMENT

FIELD OF THE INVENTION

The present invention concerns a segment of an articulated arm, for example, but not exclusively, of the type which can be installed on pumps transported on trucks for the distribution of concrete. In particular, the segment according to the present invention is made of composite material, such as carbon, aramidic or glass fibers or similar, drowned in a binding resin.

The present invention also concerns the articulated arm which comprises at least one segment of said type.

BACKGROUND OF THE INVENTION

Segments for articulated arms are known, made of metal material, which are reciprocally hinged at the respective ends and to which actuation members are associated, for example by means of brackets.

The actuation members provide to articulate one segment with respect to the other, to take them into at least a first extended or working configuration, in which they reach a desired operating position, and a second folded configuration in which the segments are folded one with respect to the other to assume a condition of minimum bulk, usually in the transport condition.

It is also known that, to reduce the overall weight of the articulated arms, the segments are made of composite material, for example comprising carbon, glass or aramidic fibers or similar, which are drowned in a binding resin.

It is also known that, when the articulated arms are in use, the segments are subjected to great stresses and vibrations and it is therefore necessary to correctly size and configure the sections of the individual segments so as to satisfy the requirements of safety and mechanical resistance.

In particular, it is known that the most stressed zones are the reciprocal hinging points between the individual segments, and also the zones where the actuation members are pivoted.

It is known that, with regard to segments made of metal material, the attachment zones are obtained by attaching, usually by welding, to the longitudinal body of the segment, one or more flanges provided with holes in which the actuation members are pivoted. In known solutions of segments made of composite material, it is known to provide that this zone is always made of metal material. In this case, solutions are known which provide to make of metal material a tract of the longitudinal body of the segment, which tract is subsequently incorporated during the step of making the segment of composite material. Said tract of metal material is in turn provided with attachment zones for the actuation members, for example consisting of brackets welded thereto.

One disadvantage of known segments is that they require a rather complex manufacturing process, and are thus costly and have too high overall weights.

Another disadvantage of known segments is that the position of the attachment zone of the actuation member, with respect to the point where it pivots with the subsequent segment, is not correlated to the mechanical resistance of the segment itself, to the size of the actuation member used and to the safety margins required. This entails the need to use actuation members with sizes that are not appropriate for the particular application on the articulated arm, and also the need to oversize the sections of particular portions of the segment, thus increasing its overall weight.

Furthermore, when they are closed on themselves, known articulated arms have a very large overall bulk, with the disadvantage that it is less easy to move and maneuver the vehicle on which the articulated arm is mounted.

U.S. Pat. No. 5,316,709 discloses an arm for an excavator comprising an articulated segment in which there are two attachment zones, the first to the segment connected to the vehicle, the second to attach the actuator that drives the excavation element. The two attachment zones are substantially at the same height in correspondence with two protruding parts of the profile of the articulated segment, which has a section shape like a double triangle with coinciding bases.

The section shape described in US'709 is not suitable to solve the disadvantages indicated above, in particular the resistance to point-by-point stresses deriving from the drive of the actuators and the reduction in bulk during the transfer and movement of the vehicle.

One purpose of the present invention is to obtain a segment of an articulated arm which is simple to make, economical and which has a lower overall weight than known segments.

Another purpose is to obtain a segment of an articulated arm that is optimized in relation to mechanical resistance, to the size of the actuation member used and to safety requirements.

Another purpose of the present invention is to obtain an articulated arm comprising at least a segment of the above type in which its overall mechanical resistance and its overall size is optimized, at least in the transport configuration.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a segment of an articulated arm is made of composite material, such as for example comprising carbon, glass or aramidic fibers or similar, made solid to each other using resins, and is applied principally, but not exclusively, on articulated arms used for the distribution of concrete.

The segment according to the present invention has an elongated shape which defines a longitudinal axis. The segment also has a box-like cross section and comprises at least a first end portion configured to allow the pivoting of a further segment, and a second intermediate portion configured to allow the pivoting of an actuation member, such as a hydraulic actuator for example, a pneumatic actuator, a screw-type jack or other. The articulated segment also has a third end portion to which further segments of the type according to the present invention or different types can be pivoted.

In accordance with one feature of the present invention, the first end portion and the second intermediate portion are made in a single body with each other, and the second intermediate portion comprises a zone protruding transverse to the longitudinal axis, defined at least by a first side and a second side converging with respect to each other and defining a vertex, advantageously rounded or with a rounded connection. First pivoting elements, for example first pivoting seatings, are made in said protruding zone, which allow to pivot the actuation member.

The two converging sides are filleted to adjacent tracts, substantially rectilinear and substantially parallel to the longitudinal axis of the segment, which define the parts of the segment adjacent to the protruding zone.

Thanks to this geometrical configuration of the segment, the actuation member, pivoted between the second intermediate portion and an articulated element associated with the first end portion, at least when the arms are in a closed position is disposed parallel to the rectilinear tract adjacent to the protruding zone in a position completely contained in the bulk of the segment itself.

In this way it is possible to obtain a segment completely in a single body that integrates the attachment zone of the actuation member and that is achieved during the same step of obtaining the rest of the segment, and with the same material.

The segment according to the present invention, and in particular the first end portion and the second intermediate portion, is defined by at least an intrados surface and an extrados surface. According to the invention, the protruding zone is obtained on the side of the intrados surface.

According to another feature of the invention, the first pivoting elements are disposed/integrated protruding with respect to the intrados surface of the cross section of the first end portion.

This particular disposition of the pivoting elements allows to optimize the positioning of the actuation member which, when the articulated arm is in its closed condition, is disposed so as to prevent conditions of interference with the other segments, with the advantage of overall compactness of the articulated arm.

According to another feature of the invention, in the intrados surface, and in correspondence with the first side of the protruding zone, at least a through cavity is made, to allow the actuation member to be inserted through it.

The protruding zone of the second intermediate portion also has a closed box-like cross section. The actuation member is therefore inserted through the through cavity to allow it to be subsequently pivoted. At least one end tract of the actuation member is therefore positioned inside the box-like section of the segment.

According to another feature of the present invention, the second side that defines the protruding zone and that is filleted to the rectilinear tract between the protruding zone and the third end portion, is inclined with respect to the longitudinal axis by an angle comprised between 5° and 25°, preferably between 10° and 20°. This angle, of a reduced value, defines a very gentle connection between the protruding zone and the adjacent rectilinear tract, and allows to obtain a good compromise between mechanical resistance of the segment and quantity of material that is used to make the latter. Too great an amplitude determines very high shearing effects in said zone, which are damaging for the purposes of the mechanical resistance; vice versa, lower amplitudes entail using a considerable quantity of material to make the segment, with consequent bigger overall sizes which not only increase the overall weight of the segment but also determine problems in closing the articulated arm which comprises said segment.

Between the second side defining the protruding zone and the third end portion there is advantageously a filleted tract that allows to confer greater mechanical resistance on the segment.

According to another form of embodiment, the second side defining the protruding zone and the filleted tract develop overall for a determinate first length of the second intermediate portion, and in particular Applicant has calculated that an optimum ratio between the rounding radius of the filleted tract and the first length is comprised between 1.8 and 7.2, preferably greater than 3.5.

According to another feature of the invention, the first side of the protruding zone, which connects the vertex of the protruding zone with the rectilinear tract of the first end portion is inclined with respect to the longitudinal axis by an angle comprised between 25° and 50°, preferably between 30° and 45°, even more preferably between 35° and 40°. Said angle, having a greater value than the angle between the second side of the protruding zone and the third end portion, as we said, allows to house the actuation member completely inside the through cavity, however preventing the actuation member from being completely enclosed inside the body of the segment. Indeed, too limited an amplitude of the angle would also reduce the possibility of movement of the actuation member, while too great an amplitude would be disadvantageous in terms of mechanical resistance of the segment, and irreconcilable with the requirements of production with the composite materials described above.

According to another form of embodiment, the first end portion is provided with at least second pivoting elements, or second pivoting seatings, configured to allow the connection of articulation elements between the actuation member and another segment.

According to some forms of embodiment, the first pivoting elements and the second pivoting elements are distanced from each other by a determinate axial distance, measured substantially parallel to the longitudinal axis, and by a determinate transverse distance. The ratio between the axial distance and the transverse distance is comprised between 3.9 and 15.6, preferably between 4.5 and 12, even more preferably between 6 and 10. This particular disposition allows to optimize the positioning of the actuation member that is associated with the segment, and also allows to limit problems of interference during the closing of the articulated arm.

According to other forms of embodiment, the first and/or the second pivoting elements comprise, integrated respectively in the first end portion and the second intermediate portion of the segment, metal inserts such as bushings, attachments or whatever else is needed to allow the pivoting of the actuation member or of brackets.

According to some preferential forms of embodiment, it may be provided that the portions disposed respectively on one side and the other of the protruding zone of the second intermediate portion have a substantially one-directional disposition of the fibers, that is, parallel to the longitudinal direction of the segment. On the contrary, the protruding zone can have a disposition of the fibers suitably modified and such as to optimize the properties of mechanical resistance required in said zone.

The present invention also concerns an articulated arm that comprises at least one segment as described above.

BRIEF DESCRIPTION OF THE DRAWINGS

These and other characteristics of the present invention will become apparent from the following description of one form of embodiment, given as a non-restrictive example with reference to the attached drawings wherein.

To facilitate comprehension, the same reference numbers have been used, where possible, to identify identical common elements in the drawings.

DETAILED DESCRIPTION OF ONE FORM OF EMBODIMENT

Figure 1:
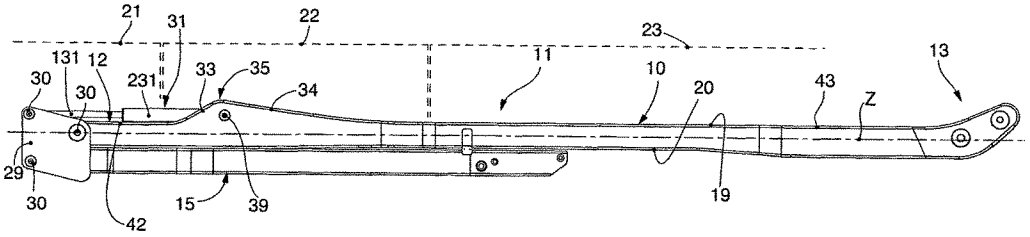
FIG. 1 is a lateral view of a segment according to the present invention, applied to a portion of an articulated arm.

With reference to FIG. 1, a segment of an articulated arm 11 is indicated in its entirety by the reference number 10 and is configured to be pivoted at a first end 12 with a first other segment 15 and at its second end 13 with a possible other second segment, not shown in the drawings.

The segments 10, 15 are made of composite material, that is, carbon, glass aramid or other fibers, made solid with each other by resins.

The segment 10 has a rectangular section, hollow inside, and develops longitudinally according to a longitudinal axis Z.

Figure 2:
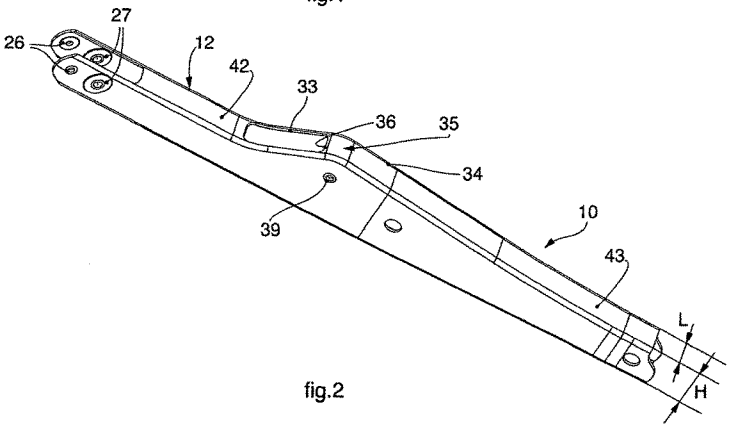
FIG. 2 is a partial prospective view of the segment according to the present invention.

The section of the segment 10 (FIG. 2) has a width L which is substantially uniform along the whole longitudinal extension, and a height H that varies along the longitudinal extension.

The segment 10 (FIG. 1) has an intrados surface 19 and an extrados surface 20 which is substantially parallel to the longitudinal axis Z.

The segment 10 according to the present invention is defined, starting from the first end 12 and in succession along the longitudinal axis Z, by at least a first end portion 21, a second intermediate portion 22 and a third end portion 23 made in a single body.

Figure 3:
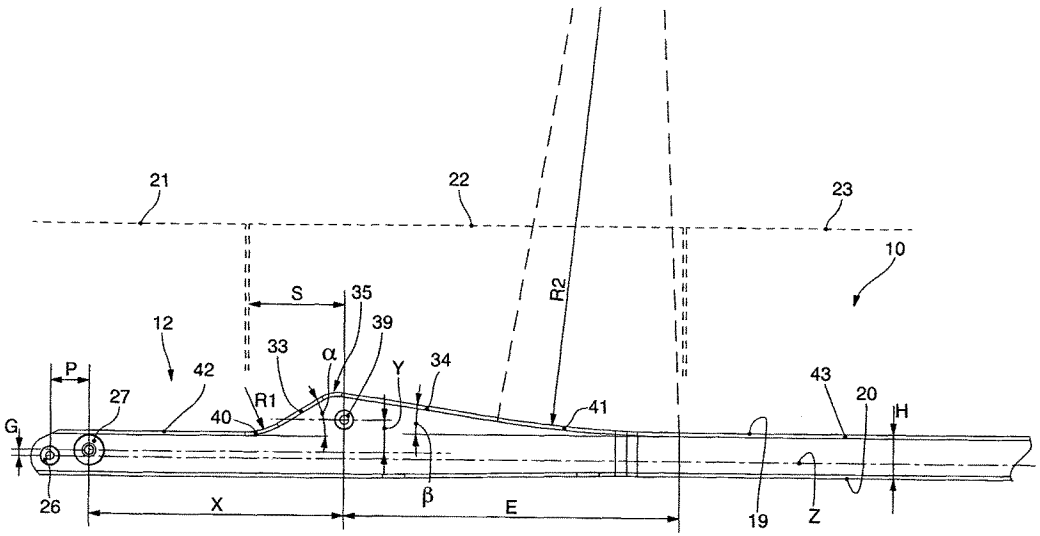
FIG. 3 is an enlarged lateral view of a portion of the segment in FIG. 1.

The first end portion 21 (FIGS. 2 and 3), or pivoting portion, is defined by a substantially rectilinear tract 42, has the height H of the cross section uniform along its axial development, and is provided with a pair of first pivoting bushings 26 and a pair of second pivoting bushings 27 associated in correspondence with the first end 12.

The third end portion 23 also comprises, adjacent to the second intermediate zone 22, a substantially rectilinear tract 43.

The first end 12 is substantially fork shaped, and the first segment 15 is introduced through it.

The first 26 and second bushings 27 are recessed in the two sides of the fork.

The first segment 15 pivots in the first bushings 26 by means of a pin, while two opposite brackets 29, only one of which is visible in FIG. 1, pivot in the second bushings 27.

The brackets 29 are provided with three pivoting holes 30 in each of which the segment 10, the end of the piston 131 of an actuation member 31 and a second connection staff, not visible in the drawings, respectively pivot.

The second connection bracket in turn pivots on the first segment 15, and provides to articulate the segment 10 and the first segment 15 with respect to each other.

The actuation member 31, in this case a hydraulic actuator, pivots with the end of its cylinder 231 in correspondence with the second intermediate portion 22 of the segment 10.

The second intermediate portion 22, or attachment portion of the actuation member 31, has a height H of the cross section that varies along the longitudinal axis Z, to define a zone protruding with respect to the intrados surface 19 of the segment 10.

More specifically, on the intrados side of the segment 10, the second intermediate portion 22 has a first side 33 facing toward the first end 12 and a second side 34 inclined and converging toward the first side 33 to define together a vertex 35, which is advantageously rounded or with a rounded connection.

In correspondence with the first side 33 a through cavity 36 is made, configured to allow an end portion of the actuation member 31 to be inserted through it.

In the second intermediate portion 22 third pivoting bushings 39 are integrated, in which the other end of the actuation member 31 is pivoted.

The third bushings 39 are integrated in the second intermediate portion 22 of the segment in an external position with respect to the intrados surface 19, so as to allow connection of the actuation member 31.

The first side 33 (FIG. 3) is inclined with respect to the rectilinear tract 42, connecting to the first end 12, by a first angle $\alpha$ comprised between 25° and 50°, preferably between 30° and 45°, even more preferably between 35° and 40° with respect to the longitudinal axis Z.

The second side 34 is inclined with respect to the rectilinear tract 43 connecting to the second end 13 by a second angle of inclination $\beta$ comprised between 5° and 25°, preferably between 10° and 20°, even more preferably by about 15° again with respect to the longitudinal axis Z.

The second angle of inclination $\beta$ is in any case less than the first angle $\alpha$, thus ensuring a gentler connection between the protruding zone and the second end 13, which is the end opposite the one where the actuation member 31 articulates.

In particular, the inclination of the second side 34 is a good compromise between the mechanical resistance properties required for the sections in that tract and the need to reduce the overall bulk so as to allow the overall reduction of the articulated arm 11 in its closed configuration.

A very reduced amplitude of the second angle of inclination $\beta$, although advantageous with regard to the reduction in intensification of tensions, would not allow the compact closure of the articulated arm 11. To this must also be added a greater quantity of material with consequent increase of the overall weight.

The first side 33 (FIG. 3) of the second intermediate portion 22 connects to the first end portion 21, and in particular to its rectilinear tract 42, with a first filleted tract 40 having a first rounding radius R1.

The second side 34, on the contrary, connects to the third end portion 23, and in particular to its rectilinear tract 43, with a second filleted tract 41 having a second rounding radius R2.

The third bushings 39 are distanced by a determinate axial distance X and by a determinate transverse distance Y with respect to the interaxis of the second bushings 27. The ratio between the axial distance X and the transverse distance Y is comprised between 3.9 and 15.6, preferably between 4.5 and 12, even more preferably between 6 and 10.

The pivoting axis of the second bushings 27 is displaced vertically, toward the intrados and with respect to the longitudinal axis Z, by a determinate gap G, comprised between 0.01 and 0.2 times the height H.

This allows to use second bushings 27 with an optimized diameter so as to suitably distribute uniformly the pressures that are generated when the actuation member 31 is driven.

The second side 34 and the second filleted tract 41 develop overall for a determinate first longitudinal length E of the second portion 22.

According to one feature of the invention, the ratio between the second rounding radius R2 and the first length E is comprised between 1.8 and 7.2, preferably more than 3.5. This ratio allows to optimize the mechanical resistance of the cross sections and the sizes of the segment 10, obtaining similar advantages with respect to what we described before for the second angle of inclination β.

The first side 33 and the first filleted tract 40 develop overall for a determinate second longitudinal length S of the second intermediate portion 22.

In order to reduce the quantity of material required to make the segment 10 in said zone, and to prevent the actuation member 31 from remaining contained inside the segment 10, it is advantageous to provide that the ratio between the second length S and the axial distance X is comprised between 0.15 and 0.65, preferably between 0.25 and 0.55, even more preferably between 0.30 and 0.50.

The first bushings 26 are offset axially by a distance P with respect to the second bushings 27. The distance P is about 0.8-1.2 times the height H of the cross section of the first end portion 21. This allows to contain the overall length of the first end portion 21, preventing useless waste of material.

In some advantageous forms of embodiment, it is provided that the second intermediate portion 22 has a particular disposition of the fibers of which it consists, different from that of the first end portion 21 and of the third end portion 23, in order to confer on this portion greater resistance to stress.

It is clear that modifications and/or additions of parts may be made to the segment as described heretofore, without departing from the field and scope of the present invention.

It is also clear that, although the present invention has been described with reference to some specific examples, a person of skill in the art shall certainly be able to achieve many other equivalent forms of segment, having the characteristics as set forth in the claims and hence all coming within the field of protection defined thereby.

The invention claimed is:

1. Segment of an articulated arm made of fiber reinforced composite material, said segment with an elongated shape defining a longitudinal axis, and having a box-like cross section, and comprising at least a first end portion, suitable to allow the pivoting of an associated further segment, a second intermediate portion configured to allow the pivoting of an actuation member, and a third end portion wherein said first end portion, said second intermediate portion and said third end portion are made in a single body with respect to each other, wherein said second intermediate portion comprises at least a protruding zone defined at least by a first side and by a second side converging with respect to each other to define a vertex, wherein said protruding zone of the intermediate portion is defined by a closed box-like cross section, wherein portions disposed respectively on one side and the other of the protruding zone have a one-directional disposition of the fibers that is parallel to the longitudinal direction of the segment, first pivoting elements being provided in said protruding zone in order to allow the pivoting of said actuation member between said protruding zone and the first end portion, wherein said first end portion is provided at least with second pivoting elements configured to allow the connection of associated articulation elements between said actuation member and the associated further segment, wherein said first and said second side defining the protruding zone are filleted to substantially rectilinear adjacent tracts of said first and third end portions, said rectilinear tracts being substantially parallel to the longitudinal axis, and wherein the angle (α) defined between first side and rectilinear tract of the first end portion is bigger than the angle (β) defined between second side and rectilinear tract of the third end portion, said angle (β), defined between said second side and said rectilinear tract of the third end portion, being comprised between 5° and 25°, with respect to the longitudinal axis, said second side being filleted to said rectilinear tract of the third end portion with a filleted tract, wherein said second side and said filleted tract extend overall for a first longitudinal length of said second intermediate portion, and in that the ratio between the rounding radius of said filleted tract and said first length is comprised between 1.8 and 7.2.

2. Segment as in claim 1, wherein said first end portion and second intermediate portion are defined at least by an intrados surface and by an extrados surface and in that said first pivoting elements are disposed protruding with respect to the intrados surface of the cross section of said first end portion.

3. Segment as in claim 2, wherein in the intrados surface, and in correspondence to said first side, at least a through cavity is made to allow the insertion through it of said actuation member.

4. Segment as in claim 1, wherein said angle (α) defined between said first side and said rectilinear tract of the first end portion is comprised between 25° and 50.

5. Segment as in claim 4, wherein said angle (α) defined between said first side and said rectilinear tract of the first end portion is comprised between 30° and 45°.

6. Segment as in claim 5, wherein said angle (α) defined between said first side and said rectilinear tract of the first end portion is comprised between 35° and 40°.

7. Segment as in claim 1, wherein said first pivoting elements and said second pivoting elements are distanced from each other by an axial distance, parallel to said longitudinal axis, and by a transverse distance, and in that the ratio between said axial distance and said transverse distance is comprised between 3.9 and 15.6.

8. Segment as in claim 7, wherein the ratio between said second length and said axial distance is comprised between 0.15 and 0.65.

9. Segment as in claim 8, wherein the ratio between said second length and said axial distance is comprised between 0.25 and 0.55.

10. Segment as in claim 9, wherein the ratio between said second length and said axial distance is comprised between 0.30 and 0.50.

11. Segment as in claim 7, wherein the ratio between said axial distance and said transverse distance is comprised between 4.5 and 12.

12. Segment as in claim 11, wherein the ratio between said axial distance and said transverse distance is comprised between 6 and 10.

13. Segment as in claim 1, wherein said second intermediate portion comprises a filleted tract interposed between said first portion and said first side, and in that said filleted tract and said first side extend overall for a second longitudinal length.

14. Segment as in claim 13, wherein the ratio between said second length and said axial distance is comprised between 0.15 and 0.65.

15. Segment as in claim 1, wherein said angle (β) defined between second side and said rectilinear tract of the third end portion, is comprised between 10° and 20° with respect to the longitudinal axis.

16. Segment as in claim 1, wherein the ratio between the rounding radius of said filleted tract and said first length is greater than 3.5.

17. Articulated arm comprising at least a segment made of fiber reinforced composite material, with an elongated shape defining a longitudinal axis, and having a box-like cross section, and comprising at least a first end portion, suitable to allow the pivoting of a further segment being pivoted to said first end portion of the segment, a second intermediate portion configured to allow the pivoting of an actuation member, and a third end portion wherein said first end portion, said second intermediate portion and said third end portion are made in a single body with respect to each other, wherein said second intermediate portion comprises at least a protruding zone defined at least by a first side and by a second side converging with respect to each other to define a vertex, wherein said protruding zone of the intermediate portion is defined by a closed box-like cross section, wherein portions disposed respectively on one side and the other of the protruding zone have a one-directional disposition of the fibers that is parallel to the longitudinal direction of the segment, first pivoting elements being provided in said protruding zone in order to allow the pivoting of said actuation member between said protruding zone and the first end portion, wherein said first end portion is provided at least with second pivoting elements configured to allow the connection of articulation elements between said actuation member and said further segment, wherein said first and said second side defining the protruding zone are filleted to substantially rectilinear adjacent tracts of said first and third end portions, said rectilinear tracts being substantially parallel to the longitudinal axis, and wherein the angle ($\alpha$) defined between first side and rectilinear tract of the first end portion is bigger than the angle ($\beta$) defined between second side and rectilinear tract of the third end portion, said angle ($\beta$), defined between said second side and said rectilinear tract of the third end portion, being comprised between 5° and 25°, with respect to the longitudinal axis, said second side being filleted to said rectilinear tract of the third end portion with a filleted tract, wherein said second side and said filleted tract extend overall for a first longitudinal length of said second intermediate portion, and in that the ratio between the rounding radius of said filleted tract and said first length is comprised between 1.8 and 7.2.

* * * * *